US007118442B2

(12) United States Patent
Laliberté et al.

(10) Patent No.: US 7,118,442 B2
(45) Date of Patent: Oct. 10, 2006

(54) CONSTRUCTION MEMBERS FOR THREE-DIMENSIONAL ASSEMBLIES

(75) Inventors: Thierry Laliberté, Loretteville (CA); Clément Gosselin, Sillery (CA)

(73) Assignee: Universite Laval, Sainte-Foy (CA)

( * ) Notice: Subject to any disclaimer, the term of this patent is extended or adjusted under 35 U.S.C. 154(b) by 0 days.

(21) Appl. No.: 10/448,312

(22) Filed: May 30, 2003

(65) Prior Publication Data

US 2004/0002278 A1 Jan. 1, 2004

Related U.S. Application Data

(60) Provisional application No. 60/383,810, filed on May 30, 2002.

(51) Int. Cl.
*A63H 33/04* (2006.01)

(52) U.S. Cl. ..... 446/85; 446/104; 446/125; 403/176

(58) Field of Classification Search ..... 446/85, 446/102, 104, 105, 107, 115, 116, 120, 125; 434/211, 278–280; 403/169–176
See application file for complete search history.

(56) References Cited

U.S. PATENT DOCUMENTS 2,776,521 A * 1/1957 Zimmerman ..... 446/115
4,055,019 A * 10/1977 Harvey ..... 446/115
4,253,268 A * 3/1981 Mayr
4,731,041 A 3/1988 Ziegler
4,792,319 A * 12/1988 Svagerko ..... 446/104
4,874,341 A * 10/1989 Ziegler ..... 446/109
4,942,700 A 7/1990 Hoberman
5,024,031 A 6/1991 Hoberman
5,100,358 A * 3/1992 Volgger ..... 446/104
5,472,365 A 12/1995 Engel
5,501,626 A * 3/1996 Harvey ..... 446/104
5,545,070 A 8/1996 Liu
5,895,306 A 4/1999 Cunningham
6,142,848 A * 11/2000 Madner et al. ..... 446/115
6,301,747 B1 * 10/2001 Parein ..... 16/260
6,665,993 B1 * 12/2003 Sorensen et al. ..... 52/591.2

FOREIGN PATENT DOCUMENTS

EP 0 109 181 A1 * 5/1984

OTHER PUBLICATIONS

Cromwell, Peter R., *Polyhedra*, Cambridge University Press, 1997 (relevant pages attached).
Wohlhart, K., *Regular Polyhedral Linkages*, proceedings of CK 2001, May 20-22, 2001, Seoul (pp. 239 and 244—attached).
Jovo™ system, as described on website www.jovo.com.
Geofix™ system, as described on website www.geoaustralia.com.

(Continued)

*Primary Examiner*—Monica Carter
*Assistant Examiner*—Ali Abdelwahed
(74) *Attorney, Agent, or Firm*—Ogilvy Renault LLP

(57) ABSTRACT

A construction member, comprising an elongated body having a longitudinal dimension with a first end and a second end. Complementary end rotational joint portions are provided at the first end and at the second end of the elongated body, for interconnecting first end to second end a plurality of the construction member so as to form a polygon with construction members. A longitudinal rotational joint portion is provided in the longitudinal dimension of the elongated body for interconnecting two longitudinally adjacent ones of the construction member so as to interconnect polygons of the construction member at a common edge of the polygons to form a polyhedron.

18 Claims, 10 Drawing Sheets

OTHER PUBLICATIONS

Polydron™ and Frameworks™ systems, as described on website www.polydron.co.uk.

Roger's Connection™ system, as described on website www.rogersconnection.com.

Geomag™ system, as described on website www.constructiontoys.com.

Magz™ system, as described on website www.naturestapestry.com/magz.html.

Polygonzo™, CuboctaFlex™, DodecaFlex™ and IcosaFlex™ systems, as described on website www.orbfactory.com.

* cited by examiner

CONSTRUCTION MEMBERS FOR THREE-DIMENSIONAL ASSEMBLIES

This patent application claims priority on U.S. provisional patent application No. 60/383,810, filed on May 30, 2002.

FIELD OF THE INVENTION

The present invention relates to construction members for the assembly of spatial mechanisms and structures, including polyhedra and geometrical shapes such as polygons, particularly but not exclusively used as a toy or as part of robotic devices.

BACKGROUND OF THE INVENTION

A polygon is a figure lying in a plane and made of a series of straight segments which form its sides, where each of the sides has an end common with the preceding and the following side. These common ends make the corners of the polygon.

A polyhedron is a 3D geometrical shape made of polygons named faces, whose common sides are the edges. The intersections of the edges of a polyhedron are the vertices. The term polyhedron is also used to describe a solid whose border is made of polygons, with the edges of the polyhedron named the skeleton. The border of a polyhedron is generally considered closed, as all the faces are in contact with other faces with all their sides. In the present context, the definition of a polyhedron will be extended to open borders when the combination of polygonal faces results in an open border.

As mentioned above, a definition describes a polyhedron as a solid whose border is made of polygons. However, the skeletons defined by the edges of given polyhedra can form mechanisms. More specifically, some polygons of polyhedra can be deformed such that some polyhedra are deformable while satisfying the geometric constraints of polyhedra.

If the polygonal faces of a polyhedron are rigid and the angles between the polygonal faces (dihedral angles) can change, mechanisms can be obtained. For instance, an open polyhedron consisting of two polygons linked by a common side can form a mechanism if the two polygons can move with respect to one another. Some closed polyhedra are deformable, yet the deformable closed polyhedra are rare and they exist only for concave polyhedra, while all the convex polyhedra are rigid. In the publication "Polyhedra" (Cambridge University Press, 1997), Cromwell describes deformable polyhedra, and provides some examples, such as the Steffen mechanism.

A class of toys has been developed from the concept of deformable polyhedra. The toys of this class are made of rigid polygon-shaped parts that can be assembled with other polygon-shaped parts by a rotational joint between each adjacent polygon-shaped part, the axis of the rotational joint lying on the common side of the polygon-shaped parts, i.e., at the junction of the polygon-shaped parts. The rotational DOF between adjacent polygon-shaped parts (i.e., the change in dihedral angle) enables versatile construction of 3D structures and mechanisms. The sides of the polygon-shaped parts are of equal length so that all polygon-shaped parts are compatible.

U.S. Pat. No. 4,731,041, issued to Ziegler on Mar. 15, 1988, U.S. Pat. No. 5,545,070, issued to Liu on Aug. 13, 1996, U.S. Pat. No. 5,895,306, issued to Cunningham on Apr. 20, 1999, and the Jovo™ website (www.jovo.com), each disclose various connections between rigid polygon-shaped plates. More precisely, U.S. Pat. No. 4,731,041 describes interlocking fingers permitting a hinging action. U.S. Pat. No. 5,545,070 introduces swivel connectors joining the polygon-shaped parts. U.S. Pat. No. 5,895,306 describes plastic hinges formed integrally with the polygon-shaped parts. The systems Polydron and Frameworks (www.polydron.co.uk), disclose hinged rigid polygon-shaped parts and polygon-shaped frames, respectively. U.S. Pat. No. 5,472,365, issued to Engel on Dec. 5, 1995, and Geofix™ (www.geoaustralia.com), disclose rigid polygon-shaped frames to be hinged to one another. In all of the above-cited references, the geometry of each of the polygon-shaped parts cannot be modified, as the polygon-shaped parts are rigid. Pieces of the above-cited references are sold in kits comprising numerous parts representing the-various basic polygons, such as the triangle, the rectangle, the pentagon, etc.

Another concept discussed in the publication "Polyhedra" is the rigidity of the skeleton of polyhedra. It is known that the triangle is the only polygon that cannot be deformed. All the other polygons are deformable in a plane, such as the rectangle that can be deformed to a parallelogram, and the square that can be deformed to a diamond. The skeleton of a cube, formed of six squares, is flexible such that any of the faces can be deformed to a diamond, and the cube is deformed to a more general parallelepiped. The skeleton of a tetrahedron, formed of four triangles, cannot be deformed. Therefore, there are some mechanisms and some structures amongst the skeletons of convex polyhedra, if proper DOF are provided.

If all edges of the skeleton of a polyhedron can change their length simultaneously while the vertex angles are constant, the polyhedron keeps its general shape but changes its size. This type of mechanism is presented in "Regular Polyhedral Linkages" by Wohlhart (CK 2001, May 20–22, 2001, Seoul, Korea, pp. 239–244), where each face of the polyhedron includes a mechanism allowing its expansion. The mechanism obtained has one degree of freedom (DOF). Such one-DOF expansion is found in many deployable mechanisms. For example, the mechanisms of Hoberman, as disclosed in U.S. Pat. No. 4,942,700, issued on Jul. 24, 1990, and U.S. Pat. No. 5,024,031, issued on Jun. 18, 1991, describe one-DOF expansion spheres and construction members for forming such mechanisms.

If all angles of a polygon or a polyhedron skeleton can vary, the figures obtained will generally be very mobile. For instance, a four-sided polygon (e.g., a rectangle) allowing all angles thereof to change, will not remain planar. A practical example of this is given by Roger's Connection system (www.rogersconnection.com), which combines rods magnetized at their ends and steel balls in order to allow the assembly of many rods on a same ball, thus creating three-DOF spherical joints between the rods. Accordingly, Roger's Connection system can be used to form an infinite number of polygons and skeletons of polyhedra, with the balls positioned at the vertices and the rods representing the edges. The polyhedron skeletons formed by Roger's Connection system are generally deformable, with angles between the sides of the polygons constituting the faces of the polyhedra changing in a plane of the polygons, but are also deformable by losing the planarity of these polygons, due to the numerous DOF provided at the vertices by the steel balls. Structures can however be obtained if triangles are used, the latter being undeformable faces. Other systems using a similar concept include Geomag (www.constructiontoys.com), Magz (www.naturetapestry.com/magz.html), and Polygonzo™, Cuboctaflex™, Dodecaflex™, and Icosaflex™ (all at www.orbfactory.com).

As mentioned above, the possibility of assembling the sides of rigid faces by rotational joints allows the fabrication of structures, but rarely of mechanisms if they represent closed convex polyhedra (i.e., the skeletons are limited to being rigid). The rotational joints allow varying of the angle between two polygonal faces, whereby many different polyhedra can be constructed with a limited number of parts. However, for the toys using rigid faces, the possible polyhedra are limited to the available parts of the toy, as the polygon-shaped parts provided are often only the triangle, square, pentagon and hexagon. Therefore, a polyhedron having octagons, such as the truncated cube or the great rhombcuboctahedron, cannot be reproduced with the above-described rigid-face toys.

On the other hand, the possibility of varying all the angles results in mechanisms with too many DOF that do not preserve the planarity of the polygons, and hence do not preserve the polyhedral geometry. There is an exception if the parts are assembled using triangles. In this case only, it is possible to obtain structures, but rarely mechanisms with relatively few DOF.

A compromise between these two options is to allow the variation of angles in the planes of the polygons in addition to allowing the variation of the dihedral angle, while preserving the planarity of the polygons. Another level of flexibility could also be provided by allowing a variation in the length of the sides.

SUMMARY OF THE INVENTION

Accordingly, an object of the present invention is to provide a new method of assembling polyhedra.

It is a further object of the present invention to provide a single construction member that can be assembled with identical construction members to form polyhedra.

It is a still further object of the present invention to provide a polyhedra assembly that can be deformed while preserving the planarity of faces of the polyhedra.

Therefore, in accordance with the present invention, there is provided a polyhedron constructed of identical construction members each having a longitudinal dimension with a first end and a second end, with complementary end rotational joint portions at the first end and at the second end, and a longitudinal rotationaljoint portion in the longitudinal dimension, the polyhedron comprising: polygons, each said polygon having at least three of the identical construction members connected first end to second end so as to form end rotational joints with the complementary end rotational joint portions; edges, each said edge being formed by a pair of the identical construction members of adjacent polygons being connected side-by-side so as to form a longitudinal rotational joint with the longitudinal rotational joint portions, each said edge being colinear with a longitudinal rotational axis of the longitudinal rotational joint; and vertices, each said vertex being formed by an intersection of at least three of the longitudinal rotational axes of three or more of said polygons.

Also in accordance with the present invention, there is provided a method for assembling a polyhedron with a plurality of identical construction members, comprising the steps of: providing identical construction members each having a longitudinal dimension with a longitudinal rotational axis, and opposed ends, each of the identical construction members being connectable to one other identical construction member at said longitudinal dimension and one other identical construction member at each said end to form rotational joints; forming polygons, each polygon being formed by interconnecting end to end at least three of the identical construction members so as to form an end rotational joint between interconnected identical construction members; and forming edges and vertices by interconnecting pairs of the identical construction members of adjacent polygons at said longitudinal dimensions such that the longitudinal rotational axes of the pair are superposed, with any one of the edges defined by the superposed longitudinal rotational axes of any one of the pairs of identical construction members, and with any one of the vertices each defined by an intersection of at least three of the edges.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENT

Figure 1:
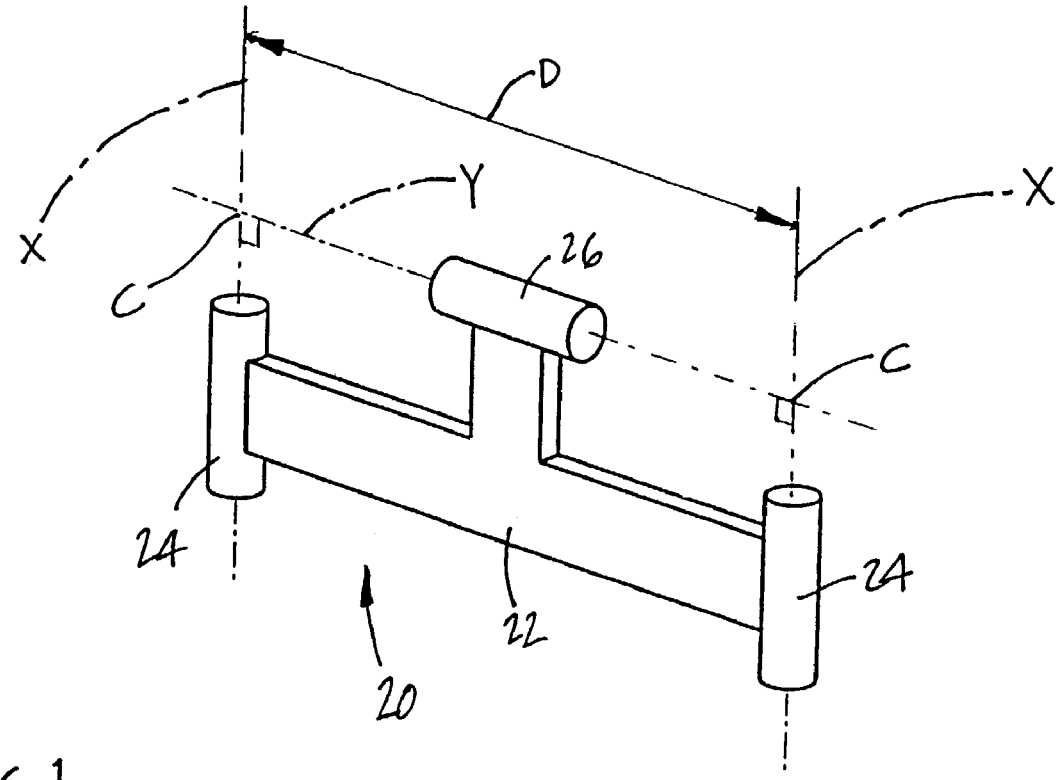
FIG. 1 is a perspective view of a schematic representation of a construction member of the present invention.

Referring to the drawings, and more particularly to FIG. 1, there is provided a construction member 20, herein shown schematically. The construction member 20 has a body 22 that connects a pair of joint members 24 and a joint member 26. The joint members 24 and 26 are portions of rotational joints that have one rotational DOF. The rotational axes of the joint members 24 are shown at X, are parallel to one another and are spaced by a distance D. The rotational axis of the joint member 26 is shown at Y, and intersects perpendicularly both axes X at points C. Therefore, the axes X and Y of one construction member 20 lie in a plane.

Figure 2:
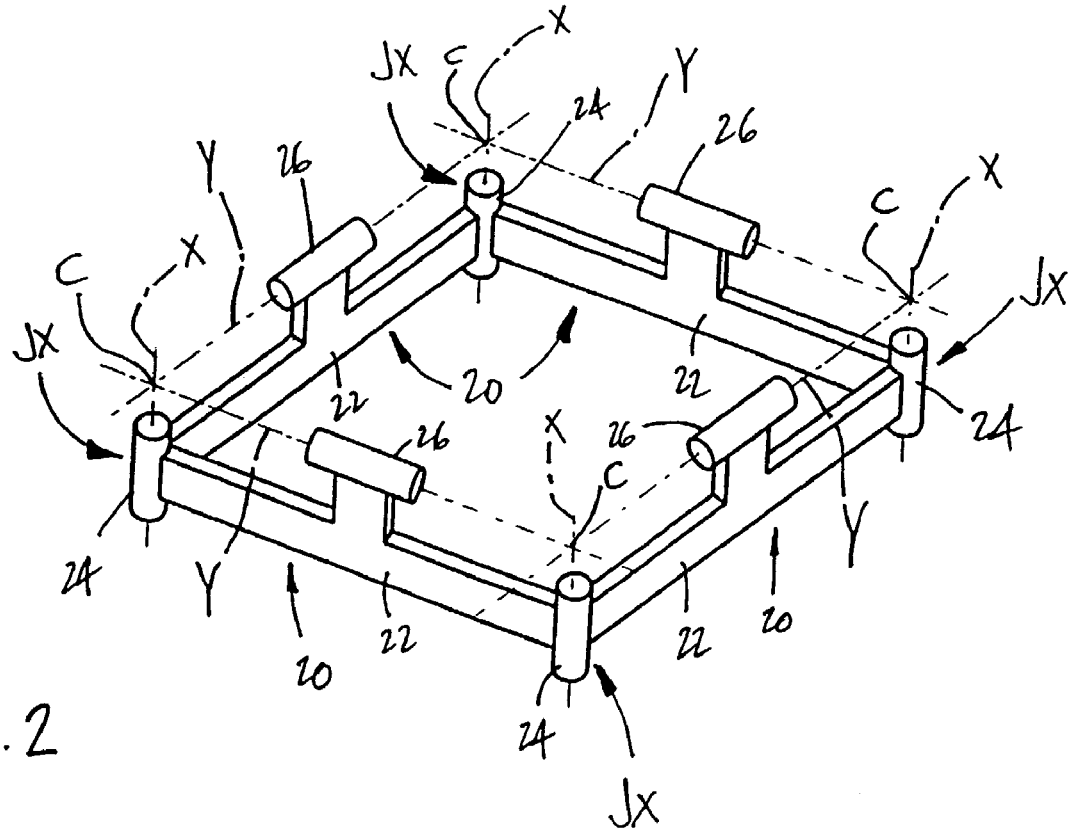
FIG. 2 is a perspective view of a schematic representation of four construction members being interconnected to form a polygon.

Referring to FIG. 2, four construction members 20 are shown interconnected. It is preferred that the joint members 24 and 26 be portions of revolute joints, and that two construction members 20 be interconnected by complementary portions of revolute joints such that there is one rotational DOF therebetween. Accordingly, interconnected joint members 24 form revolute joints JX having the rotational axis X, as shown in FIG. 2. The axis Y of each construction member 20 intersects the Y axes of the adjacent construction members 20 thereof at C, such that a polygon is formed with the axes Y being the sides of the polygon, and the points C being the corners of the polygon. The length of the sides of the polygon is equivalent to the distance D (FIG. 1). It is pointed out that the geometry of the construction member 20 ensures that any number of construction members 20 can be assembled to make planar polygons with any number of sides.

Figure 3:
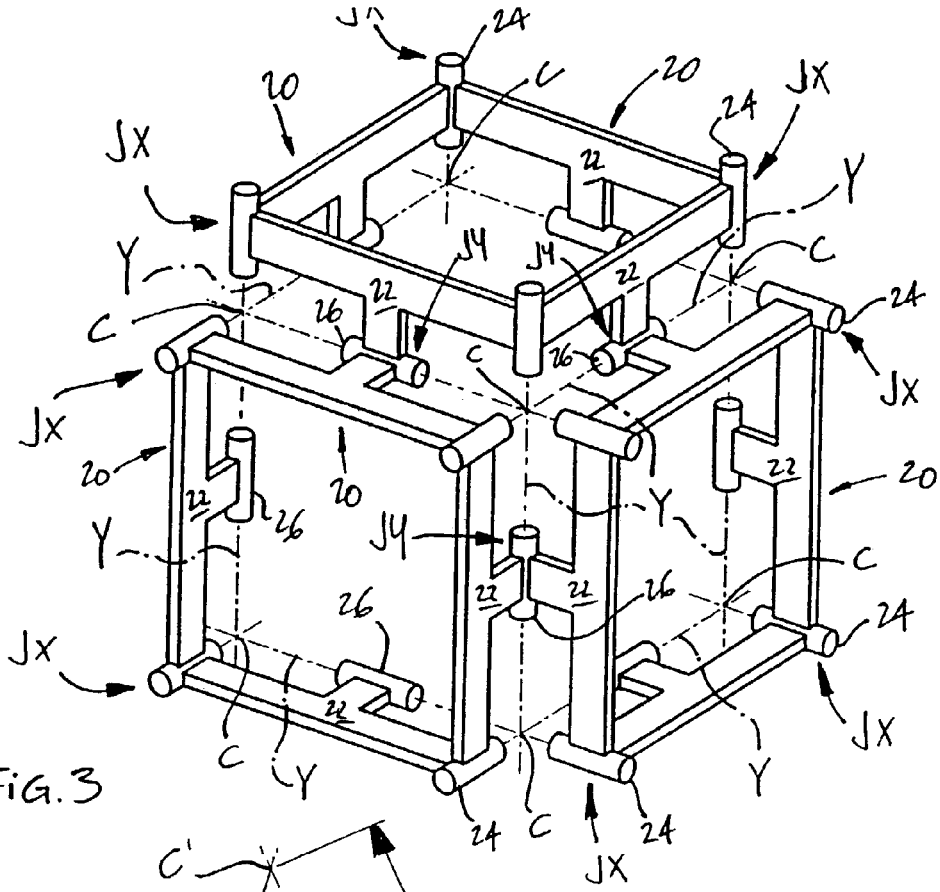
FIG. 3 is a perspective view of a schematic representation of twelve construction members interconnected to form half of a cube.

The rotational axes X are all parallel to one another in the assembly of construction members 20, such that the polygon is deformable by the change of angle between adjacent axes Y. The square-shaped polygon can be deformed to a diamond. As all rotational axes X are parallel to one another and orthogonal to the plane of the polygon, the polygon formed by the axes Y will remain planar through any deformation thereof. The joint members 26 will enable the connection of polygons with a rotational DOF therebetween. As shown in FIG. 3, twelve construction members 20 are interconnected to form half of a cube. More precisely, the half-cube of FIG. 3 corresponds to three square-shaped polygons, one of which is shown in FIG. 2, being interconnected by complementary joint members 26 forming revolute joints JY, and thus providing one rotational DOF between polygons. It is pointed out that the common edge between adjacent polygons is on the rotational axis Y, and that the vertices of the half-cube are at C.

An advantage of the above-described construction members 20 resides in that, if the length of all construction members 20 constituting a polyhedral assembly is the same, only one geometry of construction member 20 is needed. The geometry and configuration of the construction member 20 will allow building of a very large number of different polyhedra, even though these assemblies are constituted solely of identical parts. The edges of the polyhedra made of these same construction members 20 will all have a same length, which is, as described above, the distance D (FIG. 1). Among the polyhedra having this feature, there are the five Platonic solids and the thirteen Archimedean solids and the ninety-two Johnson solids (mathworld.wolfram.com).

Figure 6:
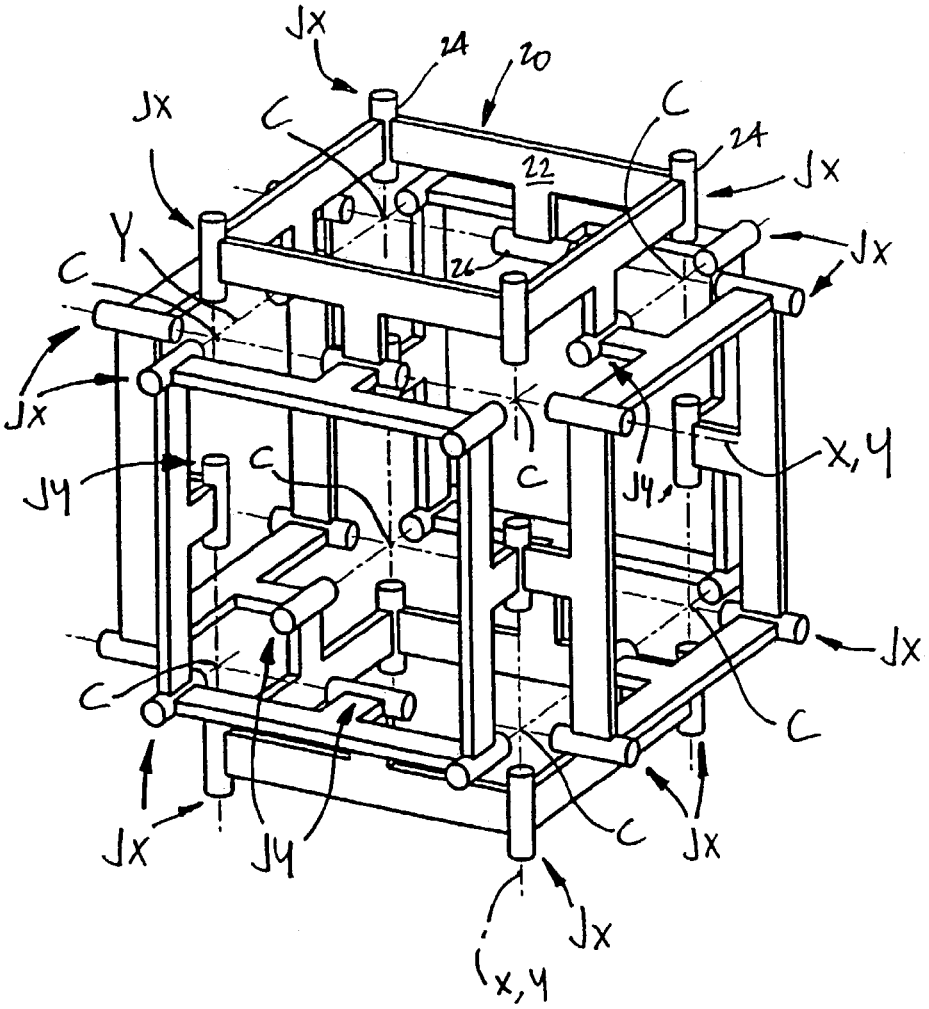
FIG. 6 is a perspective view of a schematic representation of twenty-four construction members interconnected to form a cube.
Figure 7:
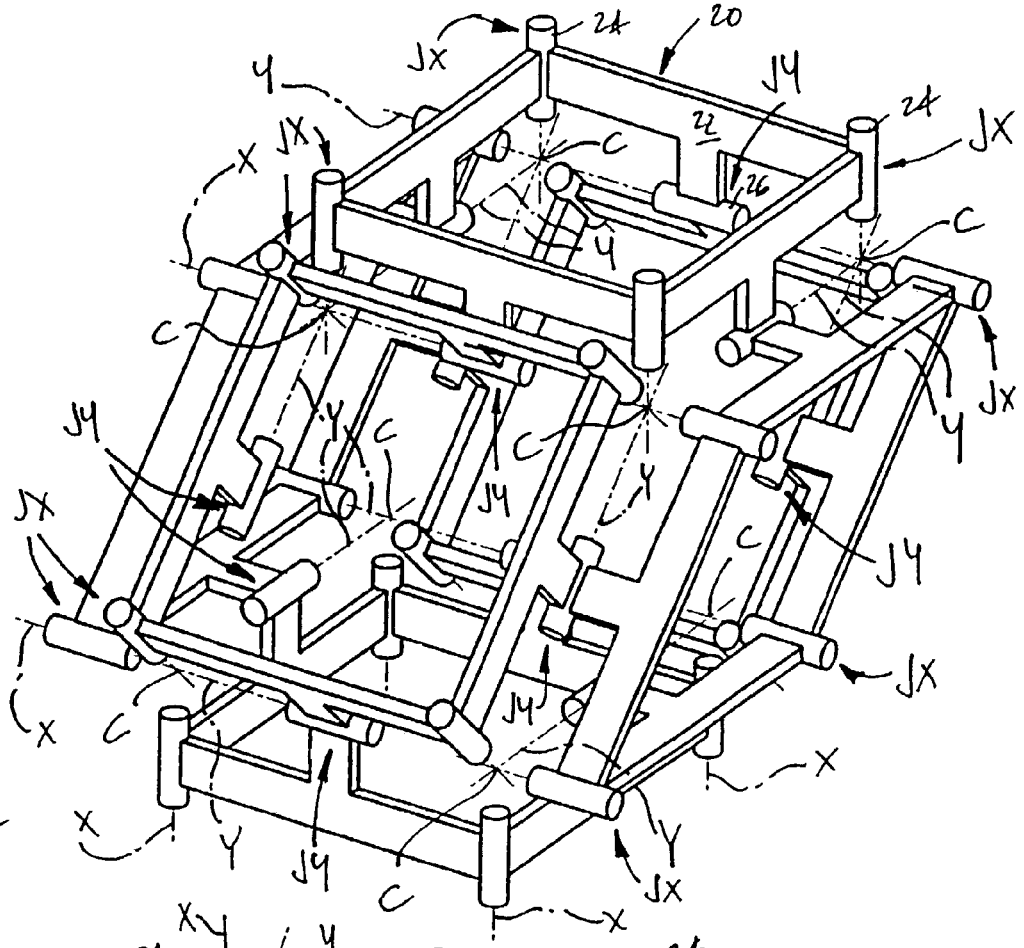
FIG. 7 is a perspective view of the cube of FIG. 6 having been deformed in accordance with the present invention.

Referring to FIG. 6, one of the five Platonic solids, the cube, is illustrated as assembled with the construction members 20. The vertices of the cube are the points C, the edges of the cube are the axes Y as delimited by the points C, and thus at the intersection with the axes X. Accordingly, the edges of the cube have the length D. For clarity purposes, only one of the construction members 20 constituting the cube of FIG. 6 bears reference numerals. The cube is deformable, as illustrated in FIG. 7. It is pointed out that the faces of the cube are constrained in remaining planar, as the rotational joints JX at the corners C of the polygons have their rotational axes X parallel to one another and orthogonal to the plane of the polygon. The mechanism defined by the construction members 20 assembled to form a cube has three DOF, and parallel edges remain parallel in any deformation for the present invention. In comparison, the assembly of a cube with rigid polygons and articulated edges would have zero DOF, and would therefore be a structure. Also, a mechanism with all angles being variable, e.g., the polygons constructed with Roger's Connection system, would generally not keep its polygon faces planar, thereby losing the polyhedral geometry.

Figure 8:
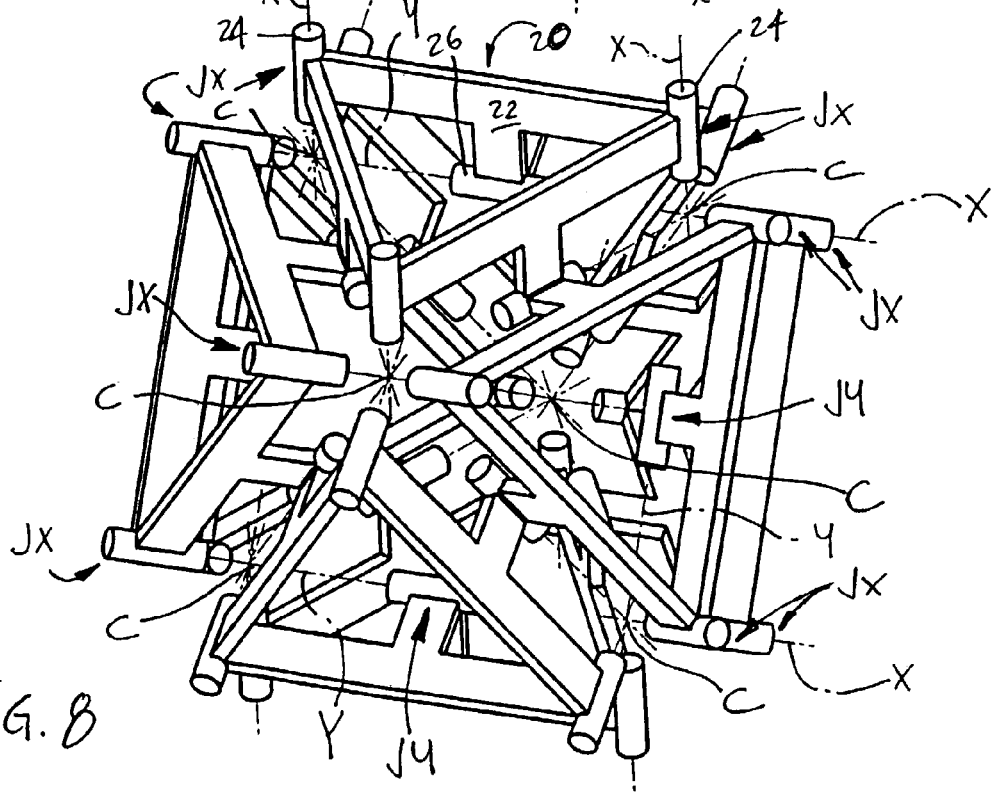
FIG. 8 is a perspective view of a schematic representation of twenty-four construction members interconnected to form an octahedron.

Referring to FIG. 8, a regular octahedron assembled of eight polygons having three equal sides is illustrated. The polygons being triangles, they cannot be deformed. The octahedron, constituted of twenty-four construction members 20, is a structure and has zero DOF. While the vertices C of the cube illustrated in FIG. 6 were the intersection of three edges, the vertices C of the octahedron illustrated in FIG. 8 are the intersection of four edges. Other polyhedra comprising vertices made of more than four edges can also be built.

Figure 9:
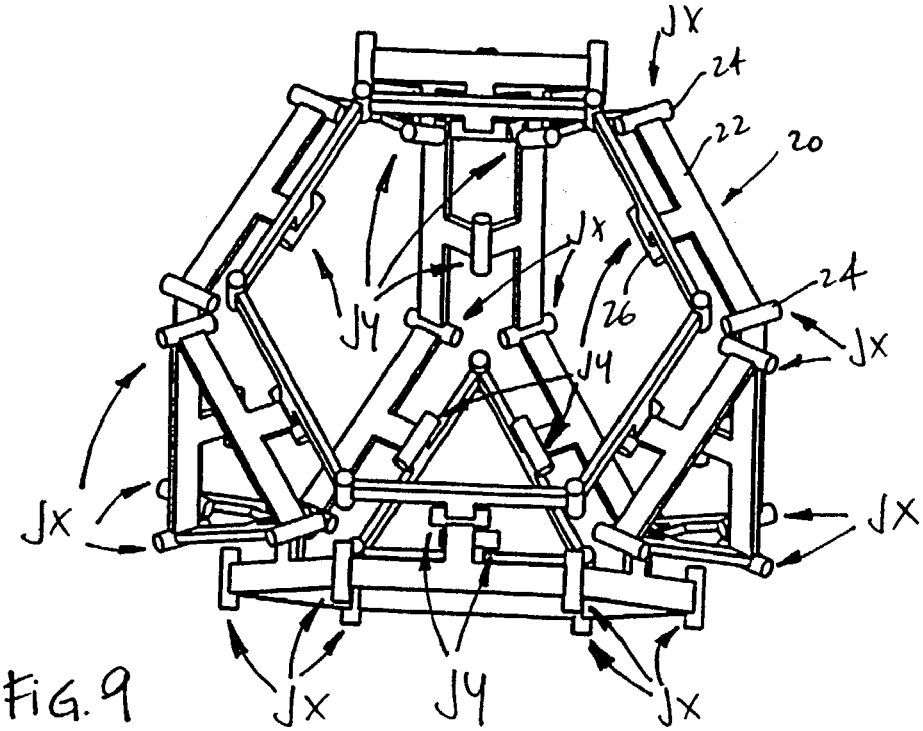
FIG. 9 is a perspective view of a schematic representation of thirty-six construction members interconnected to form a truncated tetrahedron.

Referring to FIG. 9, a truncated tetrahedron assembled of four polygons with six equal sides and four polygons with three equal sides is illustrated. This polyhedron, which is a structure, demonstrates an assembly of different polygons, namely triangles and hexagons, with the construction members 20 to form a polyhedron.

Figure 4:
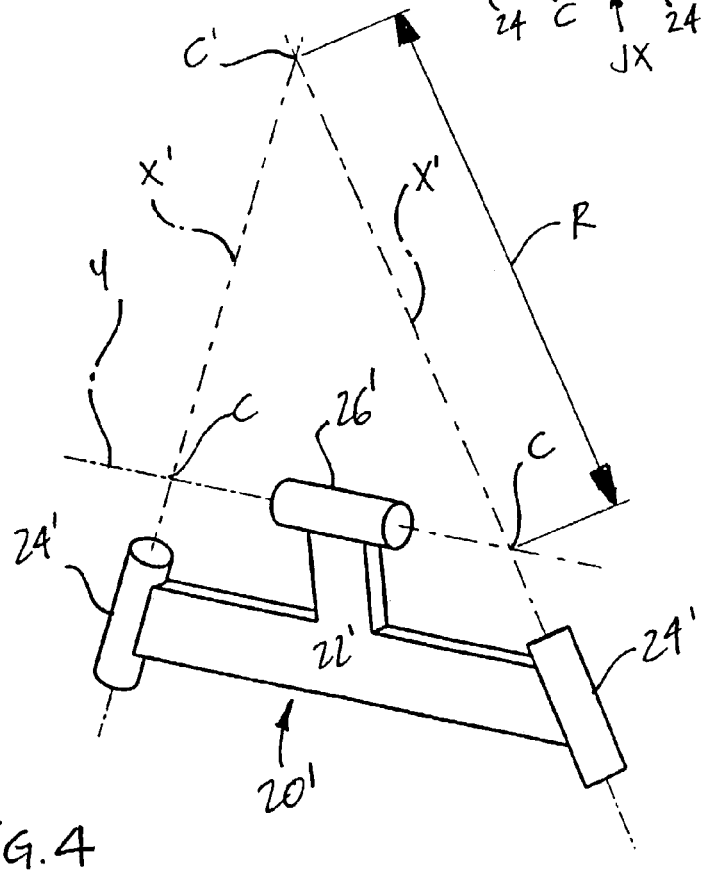
FIG. 4 is a perspective view of a schematic representation of a construction member in accordance with another embodiment of the present invention.

Referring to FIG. 4, a variation of the construction member 20 is illustrated, and is referred to as construction member 20', which has the joint members 24' positioned to have axes X' thereof intersected at a point C'. The construction member 20' also has a body 22' and a joint member 26'. If an equal angle is given between the axes X' and Y, for the axes X' to intersect at the point C', it is possible to assemble construction members 20' in order to obtain constrained polygons. The distance R between the intersection C' of the axes X' and the intersection C of the axis Y with the axes X' must be equal for all construction members 20'. Instead of moving in a plane, the corners C of the polygon move on the surface of a sphere whose radius is equal to R. Accordingly, a figure with spherical portions is obtained. However, some restrictions on the polygons are necessary. For example, if the sum of the angles between axes X' of the construction members 20' forming a polygon is larger than 360 degrees, it will be impossible to build convex spherical figures. A spherical mechanism is obtained if the radius R of the sphere of the spherical figures is the same for all figures of a mechanism. The joint members 26' are then unnecessary. It is noted that it is also possible to assemble polygons and spherical figures together.

Figure 5:
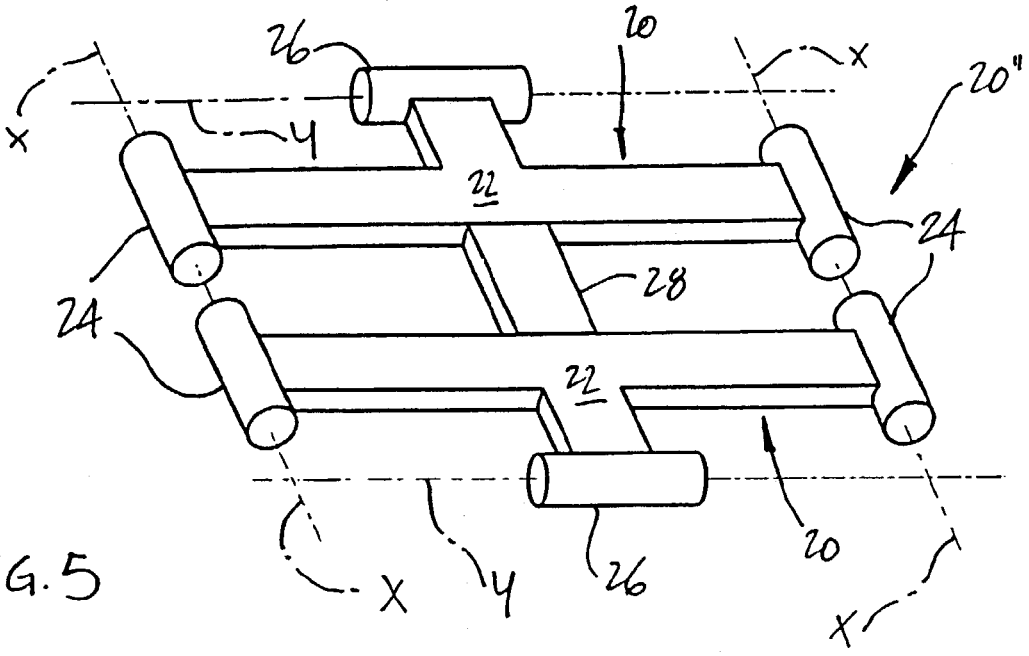
FIG. 5 is a perspective view of a schematic representation of a construction member in accordance with still another embodiment of the present invention.

As shown in FIG. 5, another variation of the construction member 20 is illustrated, and is referred to a double construction member 20". The double construction member 20" is obtained by linking rigidly two construction members 20 back to back with link 28. This double construction member 20" allows joining of polyhedra together. For simplicity purposes, as the double construction member 20" is two construction members 20, the reference numerals will be the same as for the construction member 20. The double construction member 20" has axes X colinear and axes Y parallel to one another, with all axes X and Y lying in a plane.

In providing rotational parts for the assembly of polyhedra, there must not be any material at the intersection of the axes of rotation (i.e., vertices) in order to be able to assemble the polyhedra, otherwise there is mechanical interference. Also, the joint members constituting the rotational joints must be compatible, and the rotational joints should be as compact as possible for esthetics. Obviously, it is desirable to have only one type of part that is compatible with other identical parts, as this is beneficial from economic and logistics standpoints. One such construction member is illustrated at 100 in FIG. 10 and incorporates all features of the construction member 20 of FIG. 1 and described above. The construction member 100 has a body 102 that interconnects the joint members 104, 106 and 108. The joint member 104 is a male portion of a revolute joint, whereas the joint member 106 is a female portion of a revolute joint. Both the joint member 104 and the joint member 106 have a rotational axis X. As seen in FIG. 11, construction members 100 are interconnected to form polygons by the mating of joint members 106 with corresponding joint members 104, thereby forming revolute joints JX with the rotational axes X. The rotational axes X are all parallel and orthogonal to a plane of the polygon, whereby the polygon formed will be restricted to deformation in its plane. An interesting feature of the construction member 100 is that it may be injection-molded.

Figure 10:
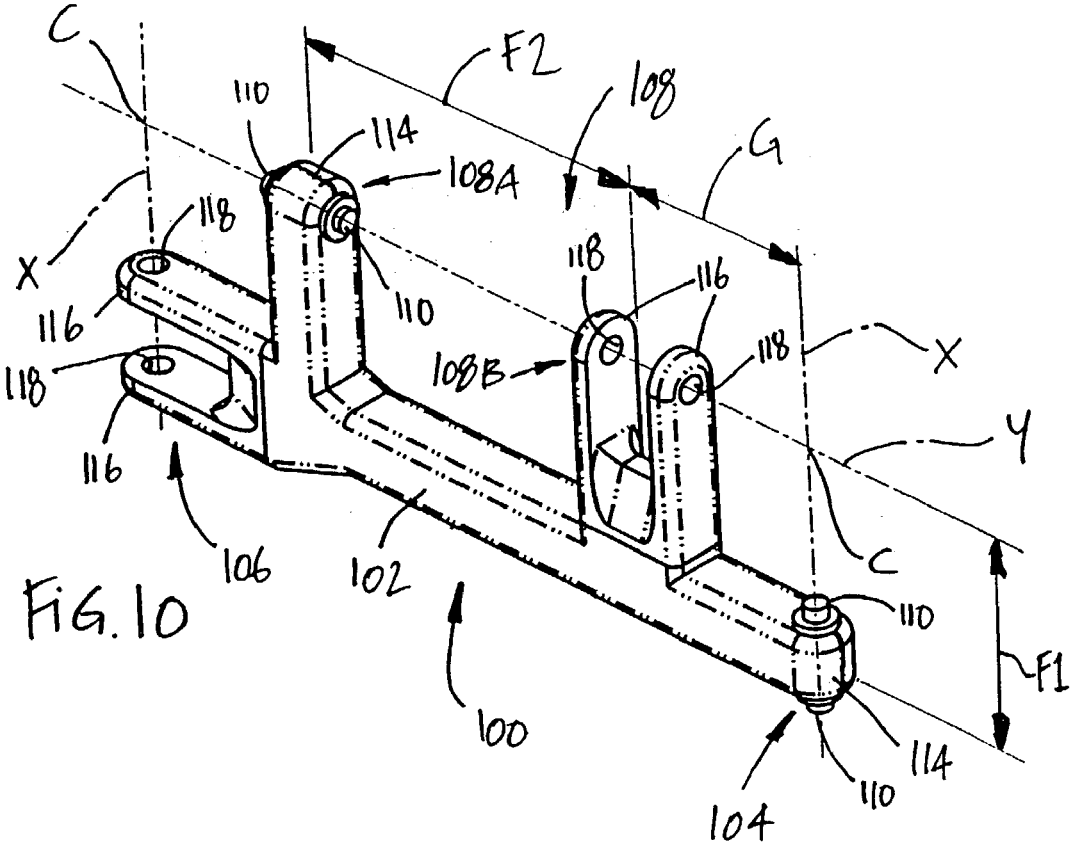
FIG. 10 is a perspective view of the construction member schematically represented in FIG. 1.
Figure 11:
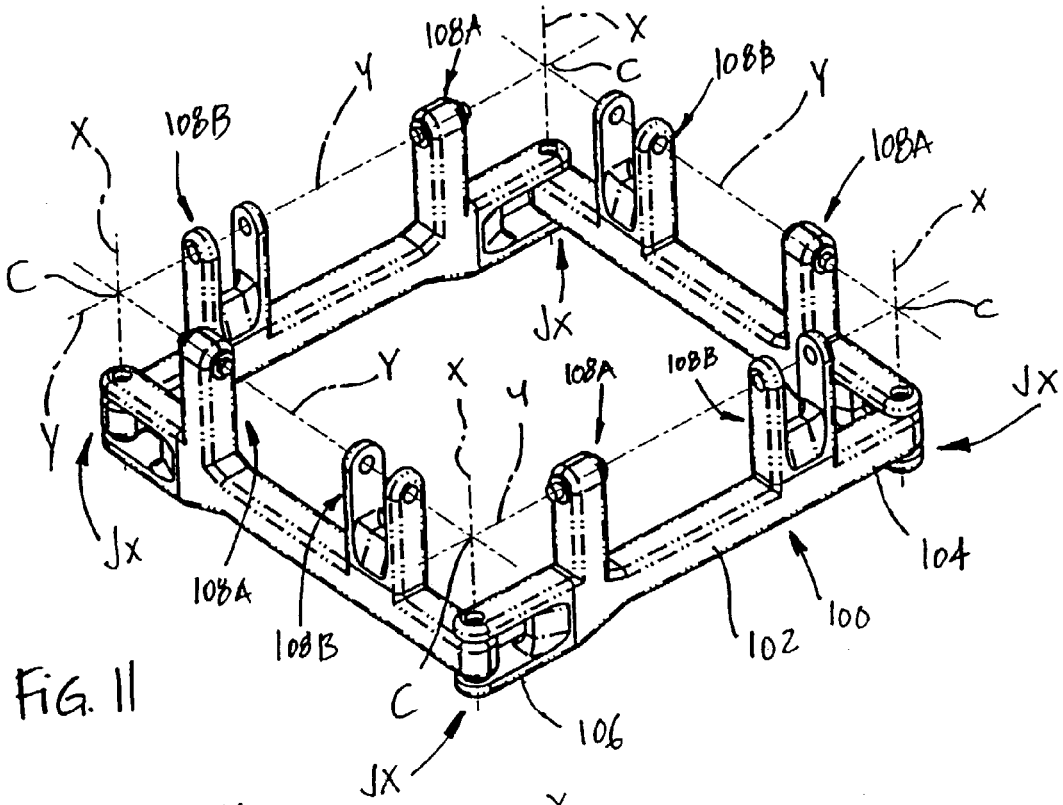
FIG. 11 is a perspective view of four construction members being connected to form a polygon.

Referring to FIG. 10, the joint member 108 consists of a male portion 108A of a revolute joint and a female portion 108B of a revolute joint, the portions 108A and 108B having a coincident rotational axis Y. The joint member 108 has the two portions (i.e., 108A and 108B) such that identical construction members 100 can be interconnected while having a same rotational axis Y. As illustrated in the half-cube of FIG. 12 formed of twelve construction members 100, the portions 108A and 108B must be positioned such that the axes X of the joint members 104 and 106 interconnected to form joints JX intersect the common axis Y at points C. Therefore, the configuration of the joint member 108 allows polygons to be with a rotational DOF therebetween.

Referring to FIG. 10, the male portion of the joints 104 and 108 are the same, and each consists of ends of a rod 110 protruding on either side of a support 114. The female portion of the joints 106 and 108 are the same and each consists of a pair of spaced strips 116 having a through bore 118. The axes X or Y pass through the center of the rods 110 or the through bores 118. The ends of the rod 110 can be inserted into the through bores 118 of the strips 116 by slightly opening the strips 116 by elastic deformation, whereby revolute joints JX are formed (FIG. 11).

Figure 12:
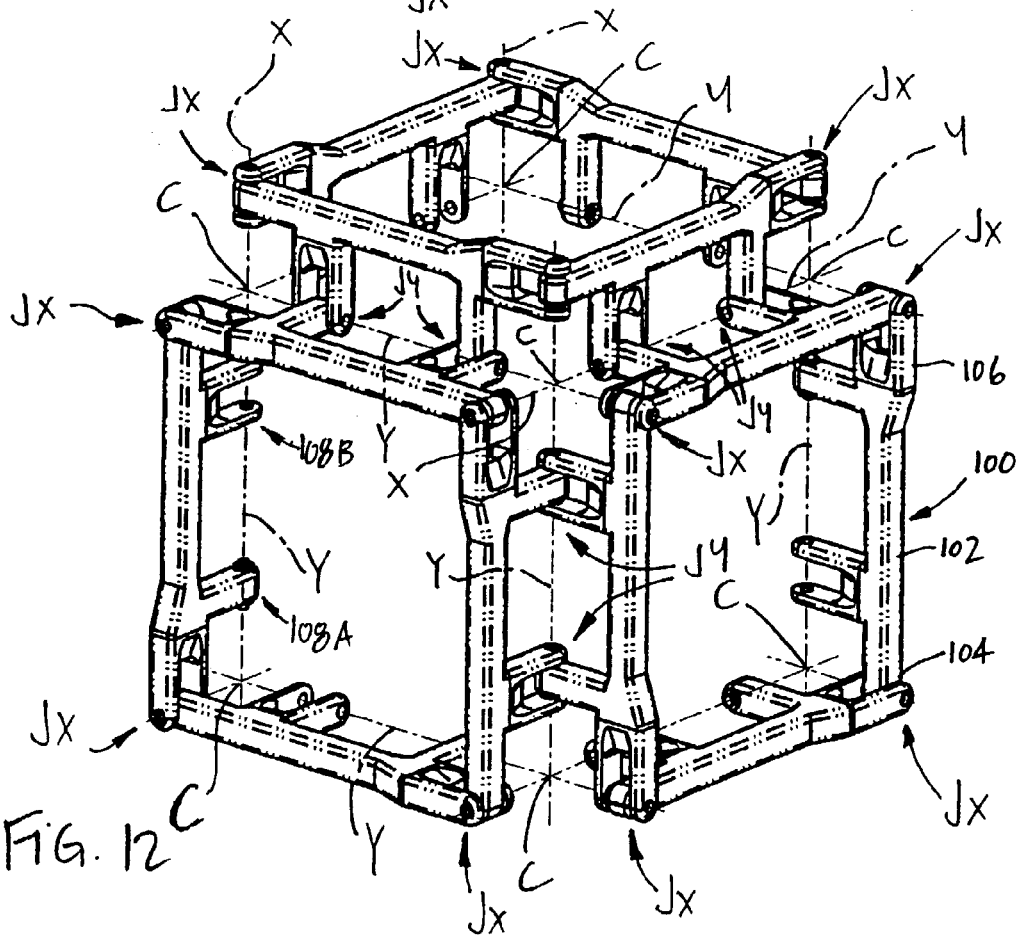
FIG. 12 is a perspective view of twelve construction members interconnected to form half of a cube.

As seen in FIGS. 11 and 12, the joints JX and JY formed of the joint members 104, 106 and 108 are offset from the intersection of the axes Y in order to avoid mechanical interference at the vertices C. It is then possible to assemble many polygons together, but two adjacent polygons cannot be pivoted about a common axis Y to reach a same plane. Referring to FIG. 10, the larger an offset F1 between a center of the body 102 and the axis Y, and the smaller the joint members 104, 106 and 108, the closer the planes of two adjacent polygons can be and the larger the range of motion. However, the bodies 102 of the construction members 100 are further from the virtual edge (i.e., the common axis Y), which reduces the structural and esthetic quality of the construction members 100. For the present example, the offset F1 is one quarter of the distance D (i.e., the spacing between the axes X) of the construction members 100. Because of the limitation of the range of motion, the polyhedra that can be assembled are only convex.

The possibilities of assembly can be increased to assemblies more general than polyhedra by adding some constraints on the geometry of the construction members 100. First, the male portion 108A of the joint member 108 must be compatible with the joint member 106, which is, as stated above, a female portion of a revolute joint, and the female portion 108B of the joint member 108 must be compatible with the joint member 104, which is a male portion of a revolute joint, as mentioned above. Also, the offsets F1 and G (FIG. 10) of these joint members from the intersection C of the rotational axes Y and X, respectively, must be the same in order to keep the joints properly intersecting. Finally, the distance F2 between the male portion 108A and the female portion 108B of joint member 108 is twice the offset F1 or G.

Figure 17:
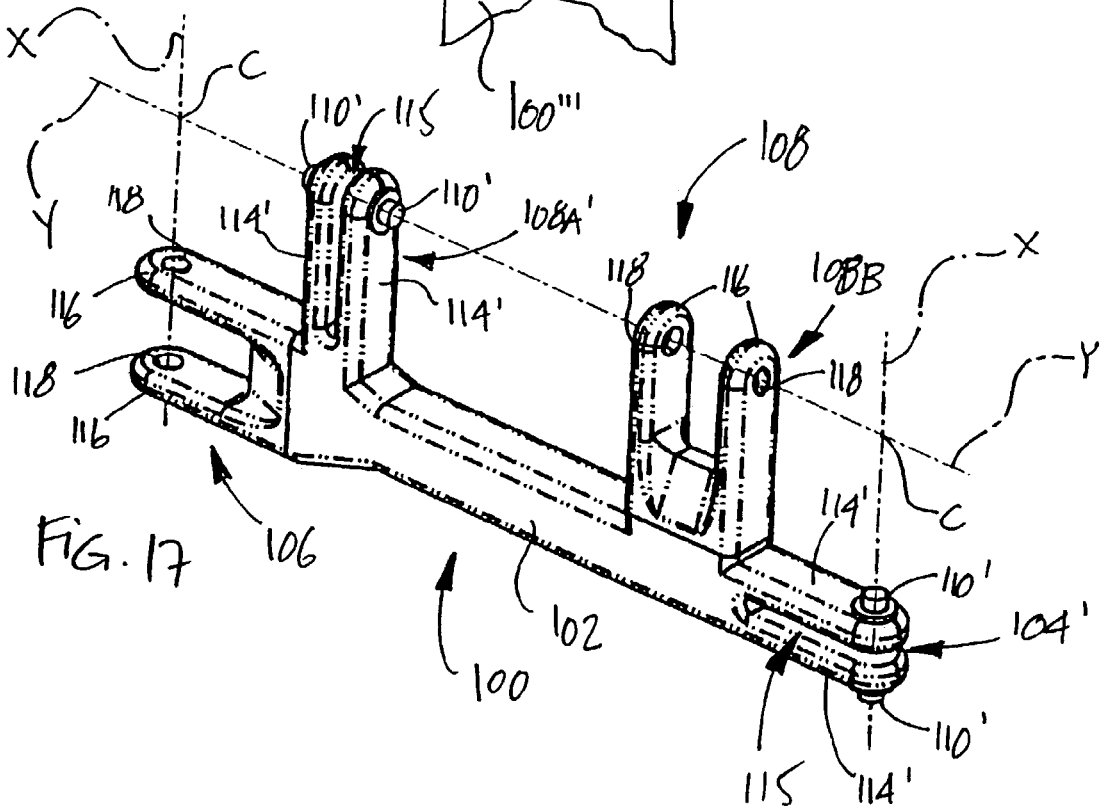
FIG. 17 is a perspective view of the construction member schematically represented in FIG. 1 and representing an alternative to the embodiment of FIG. 10.
Figure 18:
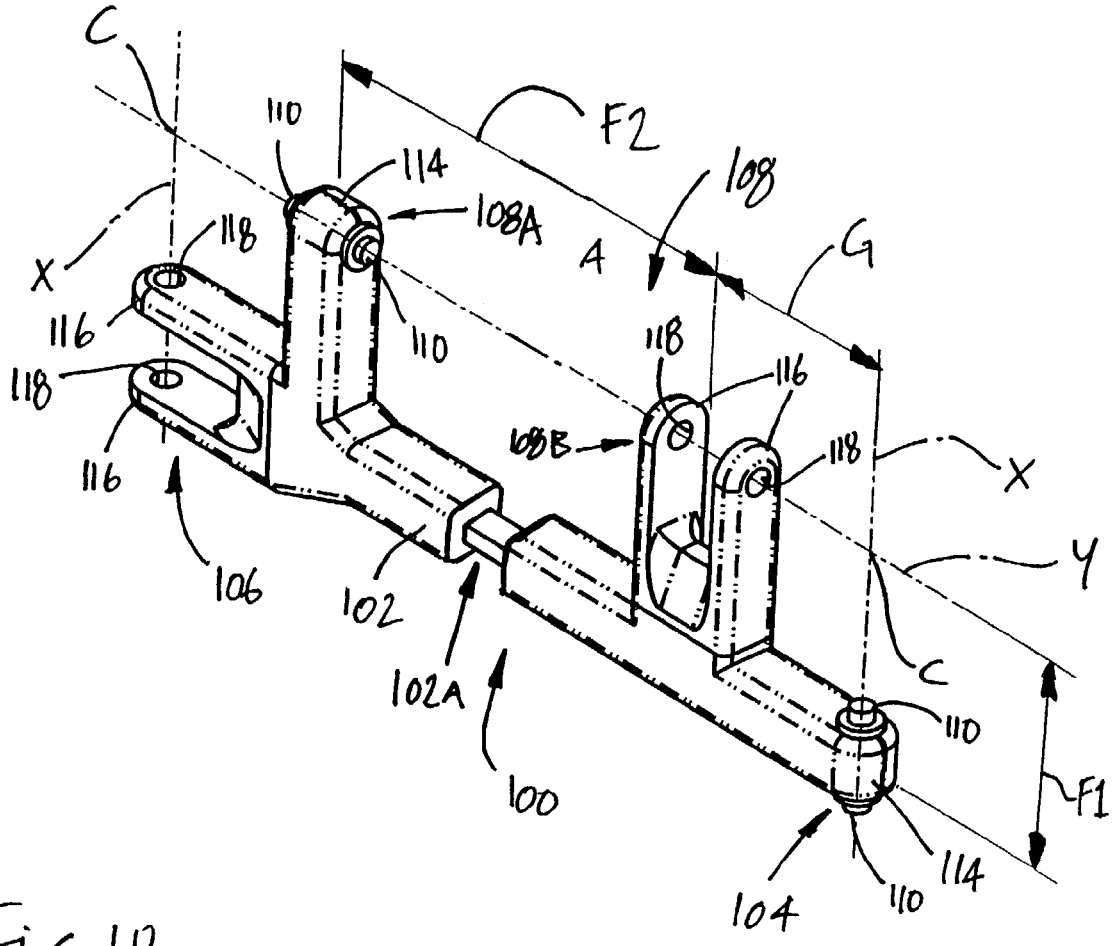
FIG. 18 is a perspective view of an expandable construction member in accordance with another embodiment of the present invention.

To facilitate the interconnection of corresponding joint members at the assembly, the construction member 100 is illustrated in FIG. 17 having the joint member 104' (equivalent to the joint member 104 of FIG. 10) and the male portion 108A' (equivalent to the male portion 108A of FIG. 10) of the joint member 108 consisting of a pair of strips 114' each having a rod 110' projecting laterally therefrom. A gap 115 separates the strips 114'. The strips 114' can be bent toward one another to facilitate the engagement of the joint member 104' and the male portion 108A' to a corresponding female joint member (i.e., joint member 106 or the female portion 108B of joint member 108). As the construction member 100 consists of a resilient material, the strips 114' will regain their initial position with respect to one another after being bent for the rods 110' to engage the holes 118 of the corresponding female joint member.

It is contemplated to provide an embodiment of the construction member in which the joint members are equipped for complementary non-mating engagement. For instance, the end joint members (e.g., 104 and 106 in FIG. 10) and the longitudinal joint members (e.g., 108A and 108B in FIG. 10) of the construction member may be provided with magnets of opposed polarity, that would ensure the interconnection of the construction members while respecting the functionality of the assemblies (e.g., co-linearity of the axes X and Y of interconnected construction members).

Figure 13:
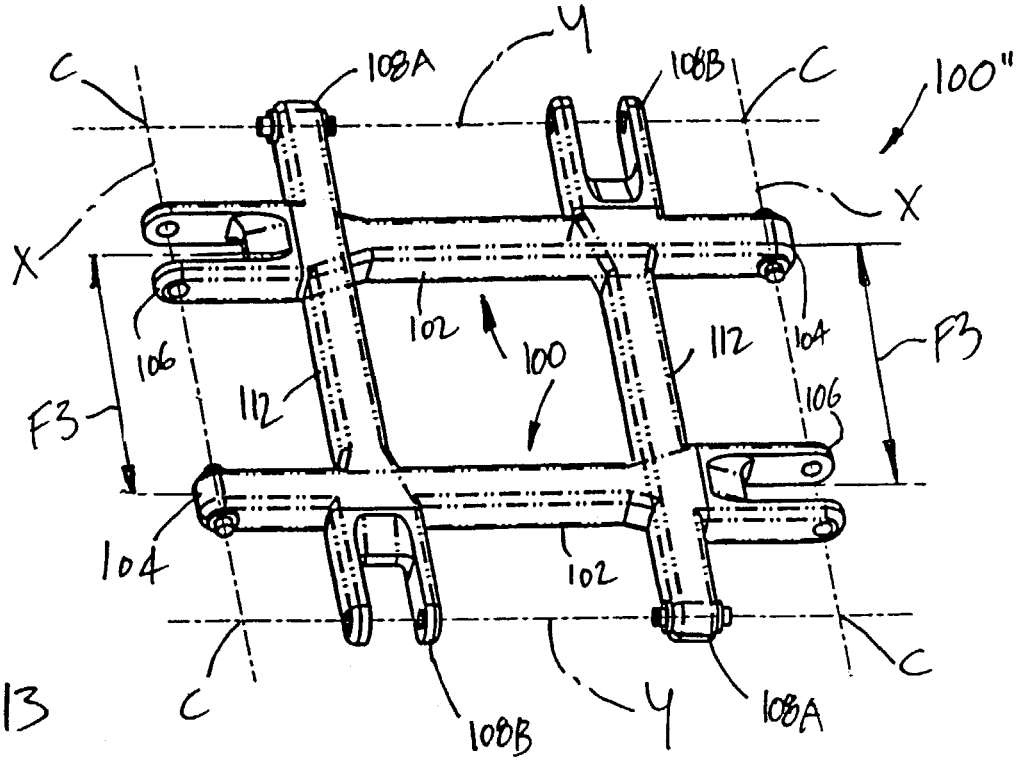
FIG. 13 is a perspective view of the construction member schematically represented in FIG. 5.
Figure 14:
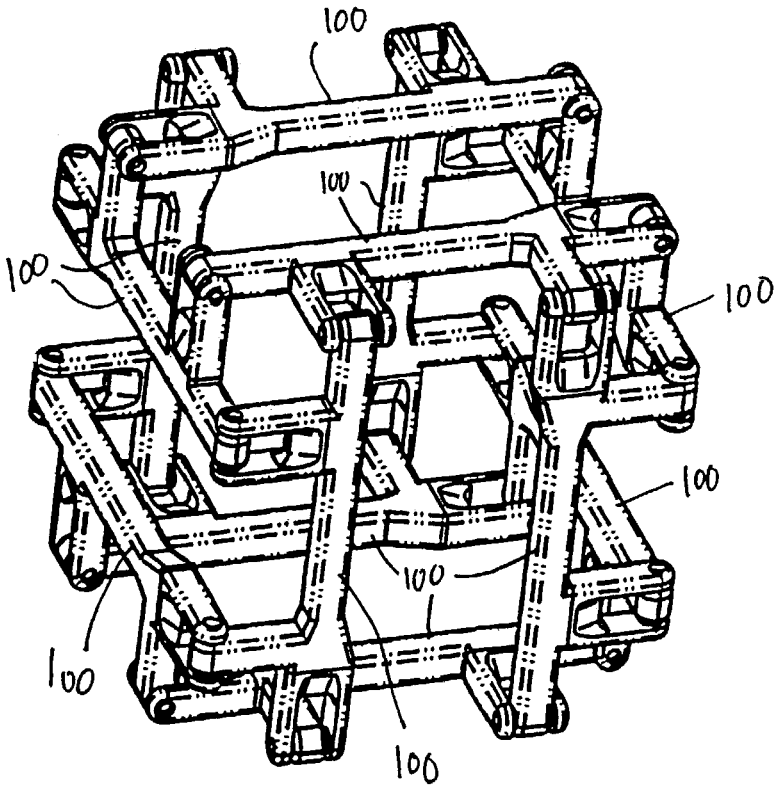
FIG. 14 is a perspective view of twelve construction members interconnected to form a rigid cube.

Referring to FIG. 13, an embodiment of the double construction member 20" of FIG. 5 illustrated at 100" is the equivalent of two construction members 100 connected by links 112. Therefore, the reference numerals of the construction members 100 will be used for simplicity purposes. It is seen that each axis X has a joint member 104 and a joint member 106. The distance F3 between the joint members 104 and 106 of a same axis X is twice the offset F1, whereby all sides of the construction member 100" are identical. With these new possibilities, the construction member 100" can be used to link two polyhedra by one of their faces if these faces are the same. Six construction members 100" interconnected to form a cube will be equivalent to the assembly of FIG. 14, wherein twelve construction members 100 form a cube that is a structure.

Figure 16:
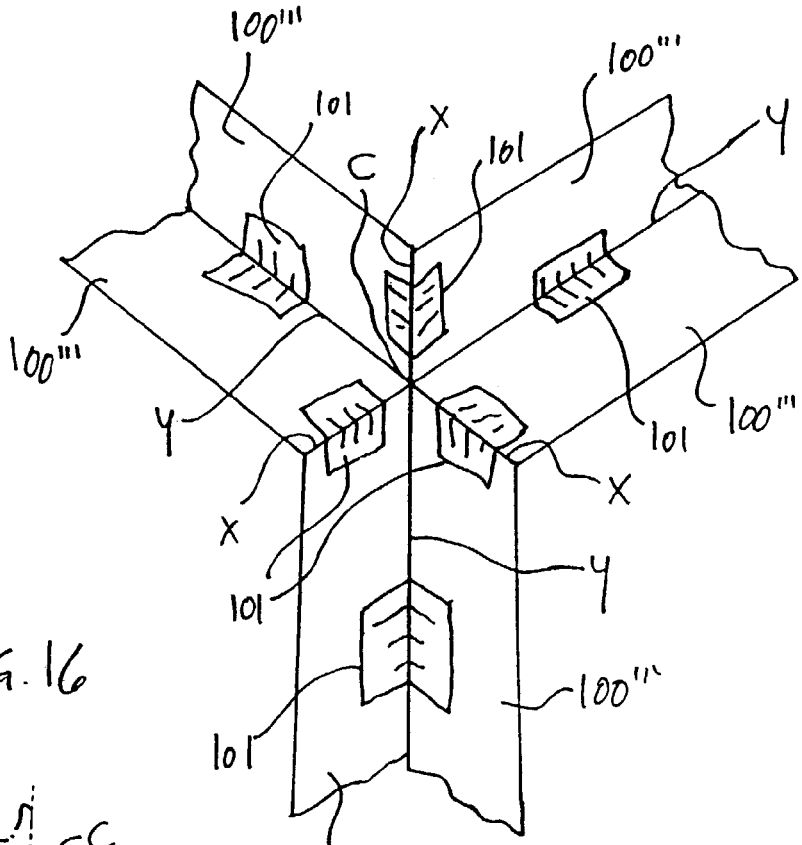
FIG. 16 is a perspective view of six construction members in accordance with another embodiment of the present invention.

Referring to FIG. 16, another possible part is a rigid rectangular part 100'''. Three sides of a rectangular part become the three rotational axes of the base part (axes X and axis Y). In order to have nice proportions, the joints JX should be on the shorter sides of the rectangular parts. The rectangular parts are then assembled at their sides by strips 101 of a flexible material. For example, the rectangular parts can be rigid cardboard and the flexible strips can be adhesive tape. As another example, the rectangular parts and the strips can be covered with Velcro™.

In order to increase the possible range of motion and to allow the coplanarity of two adjacent polygons, there can be different offsets of the physical joints from the intersection of the rotational axes Y, from a member to another. By properly matching the members, it is then possible to assemble polygons that can be coplanar and to increase the range of motion. The drawback of this solution is that many different parts must be built and that the necessary offsets can be very large.

It has been thought to provide construction members 20 having different lengths between the joint members 24. For instance, a construction member having a length between the joint members 24 of 1.4142 times the length of a pair of construction members can be used to create a right-angled isosceles triangle. It has also been thought to provide construction members having a varying length between the joint members 24. For instance, a telescopic portion or a slider mechanism in the body 102 to modify the length between the joint members 24 can be used to assemble expandable polyhedra. This is possible by changing the length of all edges formed by the construction members simultaneously while preserving the vertex angles. Such expandable construction members can also be used to create various polygons, such as right-angled triangles. Therefore, having construction members of different lengths increases the construction possibilities. An expandable construction member is illustrated at 100"" in FIG. 8. The expandable construction member 100"" is identical to the construction member 100 of FIG. 10, save for a telescopic joint 102A in the body 102. The expandable construction member 100"" allows for a variation of the F2 dimension.

Figure 15:
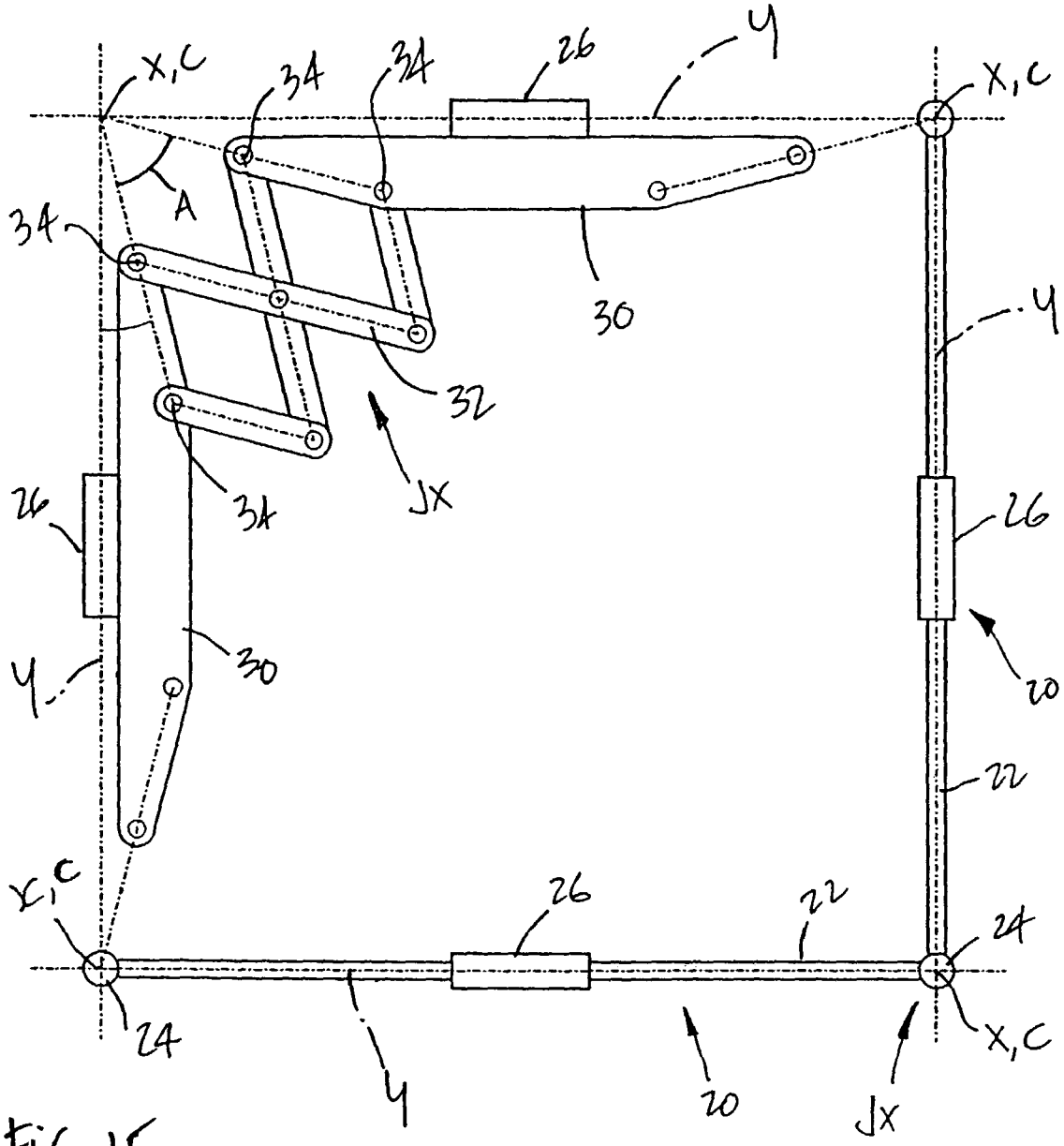
FIG. 15 is a top plan view of an alternative to the construction member.

Additionally to the absence of material at the intersection C of the axes, the absence of material on the rotational axes X would also allow the coplanarity of two adjacent polygons and would increase the range of motion. This is possible by replacing the joint members 24 (FIG. 1) by mechanisms imitating the properties of the joint members 24. For example, a parallelogram mechanism, as the ones used in cars to join the hood to the body, can be used for such purpose. A possible embodiment is illustrated in FIG. 15 and has the same reference numerals as FIG. 1 for like elements. In the present embodiment, two construction members 20 are replaced by two construction members 30 and parallelogram mechanism 32 (only one of which is shown for simplicity). The attachment points 34 of the parallelogram mechanism 32 on the construction members 30 are offset by an angle A in order to avoid mechanical interference that would happen if they were on the axis X of the joint member JX. The system is then a lot more complex, since the base part is replaced by many parts.

The invention can be used as a construction toy in which parts are assembled in order to build different polyhedra, whereby the construction members can be used as a puzzle or as part of a building kit. Once the polyhedra are built, they may serve as an educational toy illustrating properties of polyhedra. The invention can also be used as a mobile robot. For the deformable polyhedra, it is possible to actuate them in order to control their deformation. This deformation can be used to produce locomotion or other features. The invention can also be used as a parallel robot. If some of the construction members are a base and other ones are an end effector, it is possible to obtain a robot if the mechanism is actuated. Among others, the parallel robots can be used as machine tool components.

What is claimed is:

1. A polyhedron constructed of identical construction members each having a longitudinal dimension with a first end and a second end, with complementary end rotational joint portions at the first end and at the second end, and a longitudinal rotational joint portion in the longitudinal dimension, the polyhedron comprising:

polygons, each said polygon having at least three of the identical construction members connected first end to second end so as to form end rotational joints with the complementary end rotational joint portions;

edges, each said edge being formed by a pair of the identical construction members of adjacent polygons being connected side-by-side so as to form a longitudinal rotational joint with the longitudinal rotational joint portions, each said edge being colinear with a longitudinal rotational axis of the longitudinal rotational joint; and vertices, each said vertex being formed by an intersection of at least three of the longitudinal rotational axes of three or more of said polygons.

2. The polyhedron according to claim 1, wherein rotational axes of the end rotational joint portions on the construction members are parallel to one another.

3. The polyhedron according to claim 2, wherein the rotational axes of the end rotational joint portions of the construction members are perpendicular to a rotational axis of the longitudinal rotational joint portion of the construction members.

4. The polyhedron according to claim 1, wherein interconnected ones of the joint portions are matingly engaged to one another.

5. The polyhedron according to claim 4, wherein the end rotational joint portion of the first end has a female portion of a rotational joint, and the end rotational joint portion of the second end has a male portion of a rotational joint complementary to the female portion.

6. The polyhedron according to claim 4, wherein the longitudinal rotational joint portion has a female portion of a rotational joint, and a male portion of a rotational joint spaced from the female portion on the longitudinal dimension of the body and complementary to the female portion, rotational axes of the female portion and of the male portion being coincident to define a rotational axis of the longitudinal rotational joint portion.

7. The polyhedron according to claim 6, wherein the end rotational joint portion of the first end has a female portion of a rotational joint, and the end rotational joint portion of the second end has a male portion of a rotational joint complementary to the female portion.

8. The polyhedron according to claim 6, wherein a distance between the female portion and the male portion in the longitudinal dimension is of two dimension units, a distance between the female portion and an adjacent intersection of rotational axes of the longitudinal rotational joint portion and of an adjacent one of the end rotational joint portions is of one dimension unit, and a distance between the male portion and of an adjacent intersection of rotational axes of the longitudinal rotational joint portion and of an adjacent one of the end rotational joint portions is of one dimension unit.

9. The polyhedron according to claim 7, wherein a distance between the female portion and the male portion in the longitudinal dimension is of two dimension units, a distance between the female portion and an adjacent intersection of rotational axes of the longitudinal rotational joint portion and of an adjacent one of the end rotational joint portions is of one dimension unit, and a distance between the male portion and of an adjacent intersection of rotational axes of the longitudinal rotational joint portion and of an adjacent one of the end rotational joint portions is of one dimension unit.

10. The polyhedron according to claim 9, wherein the male portion and the female portion of the longitudinal rotational joint portion are respectively complementary to the female portion and the male portion of the end rotational joint portions, for engagement of ends of the construction members to longitudinal joint portions of adjacent ones of the construction members to form rotational joints therebetween.

11. The polyhedron according to claim 9, wherein a distance between the end rotational joint portions and the rotational axis of the longitudinal rotational joint portion is of one dimension unit.

12. The polyhedron according to claim 1, further comprising a connector in the longitudinal dimension of the elongated body and away from the longitudinal rotational joint portion, for being connected to an adjacent one of the construction members of another polyhedron, to interconnect polyhedra.

13. The polyhedron according to claim 1, wherein the construction members are injection-molded.

14. The polyhedron according to claim 1, further comprising a joint in the elongated body such that said longitudinal dimension is expandable.

15. The polyhedron according to claim 1, wherein a polygon is formed with at least one of the construction members and a parallelogram mechanism equivalent to two of the construction members in the polygon.

16. The polyhedron according to claim 1, wherein polygons in the polyhedron formed with a plurality of the construction members are deformable while remaining planar.

17. A method for assembling a polyhedron with a plurality of identical construction members, comprising the steps of:

providing identical construction members each having a longitudinal dimension with a longitudinal rotational axis, and opposed ends, each of the identical construction members being connectable to one other identical construction member at said longitudinal dimension and one other identical construction member at each said end to form rotational joints;

forming polygons, each polygon being formed by interconnecting end to end at least three of the identical construction members so as to form an end rotational joint between each interconnected pair of identical construction members; and forming edges and vertices by interconnecting pairs of the identical construction members of adjacent polygons at said longitudinal dimensions such that the longitudinal rotational axes of the pair are superposed, with any one of the edges defined by the superposed longitudinal rotational axes of any one of the pairs of identical construction members, and with any one of the vertices each defined by an intersection of at least three of the edges.

18. The method according to claim 17, wherein said identical construction members have complementary mating joint portions at said longitudinal rotational axis and at said ends, such that interconnected ones of the identical construction members are matingly interconnected in the step of forming edges and vertices.

* * * * *